US006381786B1

(12) United States Patent
Cadden

(10) Patent No.: US 6,381,786 B1
(45) Date of Patent: May 7, 2002

(54) INFANT FEEDING PILLOW

(76) Inventor: Lisa Conigliaro Cadden, 32 Rhodes St., Cumberland, RI (US) 02864

( * ) Notice: Subject to any disclaimer, the term of this patent is extended or adjusted under 35 U.S.C. 154(b) by 0 days.

(21) Appl. No.: 09/374,837

(22) Filed: Aug. 14, 1999

(51) Int. Cl.[7] ..... A47G 9/00
(52) U.S. Cl. ..... 5/655; 5/646
(58) Field of Search ..... 5/655, 636, 639, 5/640, 646, 652, 657; D6/601

(56) References Cited

U.S. PATENT DOCUMENTS

| | | | | | |
|---|---|---|---|---|---|
| 4,393,520 | A | * | 7/1983 | Koch | 5/655 X |
| 4,651,349 | A | | 3/1987 | Heiler | 2/104 |
| 4,815,639 | A | * | 3/1989 | Lehman | 5/655 X |
| D315,845 | S | * | 4/1991 | Lafley | D6/601 |
| 5,159,727 | A | * | 11/1992 | McCracken | 5/655 |
| 5,239,717 | A | * | 8/1993 | Sue | 5/655 |
| 5,440,769 | A | * | 8/1995 | Thomas | 5/655 |
| 5,707,031 | A | | 1/1998 | Creighton-Young | 248/118 |
| 6,041,458 | A | * | 3/2000 | Vickers et al. | 5/636 |

* cited by examiner

*Primary Examiner*—Robert G. Santos
(74) *Attorney, Agent, or Firm*—Salter & Michaelson

(57) ABSTRACT

An infant pillow feeding sleeve that is unitary, cylindrical in form, and advantageously includes filler is described. During use, the sleeve is slipped over the arm of the care giver such that is generally centered over the care givers elbow. When the arm is bent to position the baby for feeding, the sleeve forms a pillow against which the infants head may rest. The pillow acts to lift the infants head up to a breast or bottle for feeding, thereby reducing fatigue and increasing the comfort of the care giver and the child.

7 Claims, 2 Drawing Sheets

INFANT FEEDING PILLOW

FIELD OF THE INVENTION

This invention relates generally to the field of infant care and more particularly to an apparatus for facilitating infant feeding.

BACKGROUND OF THE INVENTION

During the first few months of life, an infant is exclusively fed either breast milk or formula. Formula fed infants are generally fed by placing the infants head in the crook of a care givers arm, and feeding the formula to the infant with a bottle. Breast-fed infants are fed by raising the infants head to the breast. As many who have experienced the art of breast-feeding know, a certain amount of dexterity, coordination, and often discomfort is associated with getting the infants head properly aligned with the breast and keeping it there during the feeding.

During the first few weeks of an infants life, feedings may be needed twelve or more times a day. Often, the feedings may last in duration anywhere from twenty minutes to an hour. Because of the amount of time that is spent in this task, it is important that it is comfortable for both the infant and the care giver. However, there are some discomforts associated with feeding. Although the infant is small, the weight of the infant on the care giver's arm may cause increased fatigue in the arm. For breast-fed infants, because the crook of the arm is not always perfectly aligned with the breast, a nursing mother frequently either has to lift the child up to the breast or alternatively bend her upper body down towards the child. Both approaches, repeated frequently during the day, may cause pain and discomfort to the mother.

A number of products have been provided to alleviate this discomfort. One product, for example, is a generally U shaped pillow, meant to be placed around the waist of the care giver. The care giver may rest the arm holding the infant on the pillow, thereby raising the infant to a comfortable height for breast or bottle feeding. However the nursing pillow is difficult to position because it does not fit easily around the care giver and hinders the ability of the care giver to lean backwards into a chair. The difficulty of positioning a nursing pillow is a real problem, since the pillow may need to be repeated positioned throughout the feeding. For example, the pillow is repositioned each time the infant is burped and when the infant is switched from one breast to another. Often, the nursing pillows become more of a hindrance to the nursing process than an aid.

Another drawback of the nursing pillows is that their size makes them difficult to transport. Because there are a large number of items that must be transported with the child, it is not always feasible to add a large nursing pillow to the pile.

A further drawback with typical nursing pillows is that they are not readily cleanable. Feeding can be a messy task. However, it is desirable to undergo the feeding in as clean a condition as possible. Most nursing pillows are only spot cleanable and therefore may not necessarily meet the sanitary standards desired by the care giver.

SUMMARY OF THE INVENTION

According to one aspect of the invention, a pillow feeding sleeve is provided. The pillow feeding sleeve is unitary, cylindrical in form, and advantageously includes filler. During use, the pillow feeding sleeve is slipped over the arm of the care giver such that is generally centered over the care givers elbow. When the arm is bent to position the baby for feeding, the sleeve forms a pillow against which the infants head may rest. The pillow acts to lift the infants head up to a breast or bottle for feeding, thereby reducing fatigue and increasing the comfort of the care giver and the child.

According to one aspect of the invention, an infant feeding apparatus includes a sleeve having an interior lining and an exterior lining, with the interior and exterior linings adjoined at each end of the sleeve, the sleeve for extending over the arm of a care giver and forming, when the arm of the care giver is bent for feeding, a pillow for resting the head of the infant.

According to a further aspect of the invention, an infant feeding sleeve includes a first cylindrically shaped lining having a first and second end, a second cylindrically shaped lining, disposed within the first cylindrically shared lining, and joined to the first lining at the first and second ends and filler, disposed between the first and second cylindrically shaped linings.

DESCRIPTION OF ILLUSTRATIVE EMBODIMENTS

Figure 1:
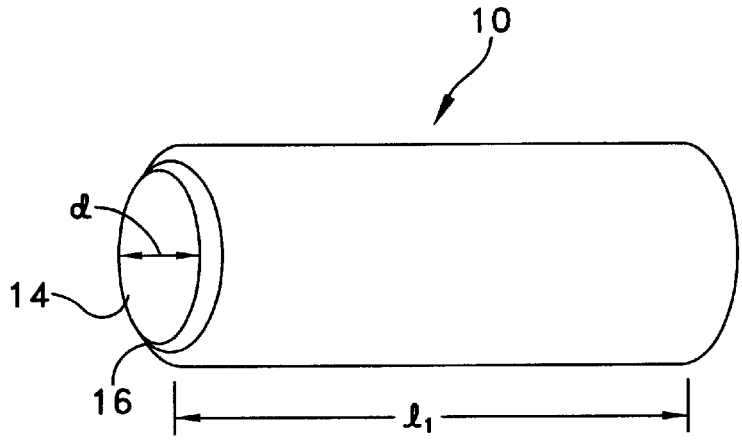
FIG. 1 illustrates one embodiment of a pillow feeding sleeve according to the present invention.

Referring now to FIG. 1, one embodiment of a pillow feeding sleeve 10 is shown. The pillow feeding sleeve 10 is generally cylindrical in shape, having an exterior lining 12 and an interior lining 14. The pillow feeding sleeve is flexible and made of a soft, washable material. In one embodiment, the linings 12 and 14 are made from fabric such as a cotton, polyester, or a blend thereof, although any type of fabric could be used. Alternatively, either of the linings may be made from vinyl or a soft plastic. The linings 12 and 14 may be made from the same material, or may be made from different materials. For example, the linings may be selected such that they have different textures for stimulating the infant in a different manner, or different colors (such as pink and blue) associated with different sexes of infants. The linings are reversible; i.e., the sleeve may be folded inside-out to display the desired ling. Although a variety of material selections has been described, the present invention is not limited to any particular type of material.

Between linings 12 and 14 is a space 16. Disposed in space 16 may be a filler to add extra cushioning to the sleeve, although this is not a requirement of the invention. Examples of the fillers include, but are not limited to, down, fiber-fill and a mix thereof. Alternatively, a pillow feeding sleeve having plastic or vinyl linings may be inflated with air.

The pillow feeding sleeve 10 is of a length $l_1$ and a diameter d. The length $l_1$, is selected such that the sleeve, when slipped over the arm of a care giver, will cover the interior portion of the arm, opposite the elbow, and extend for a desired length over the forearm and up the upper arm of the care giver. The length $l_1$ should be at least long enough to adequately cradle the head of an infant when the arm is in bent position. An exemplary length $l_1$ is 12 inches, although the present invention is not limited to such a measurement.

The diameter d is selected to allow a variety of sizes of arms to be inserted into the pillow feeding sleeve 10, while still allowing the arm to bend within the sleeve. An exemplary diameter d is 8 inches, although the present invention is not limited to such a measurement.

Figure 2:
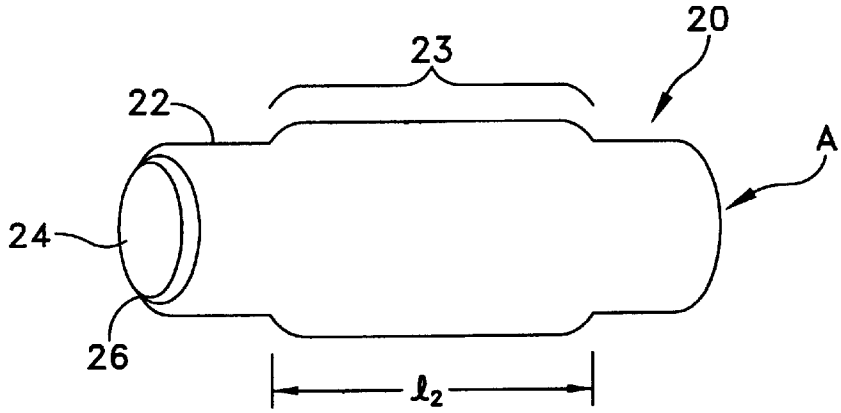
FIG. 2 illustrates a second embodiment of a pillow feeding sleeve according to the present invention.
Figure 3:
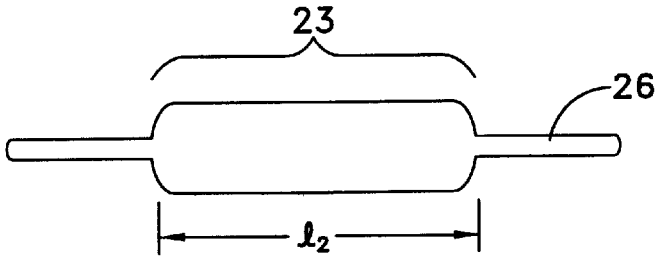
FIG. 3 illustrates a cross section of the pillow feeding sleeve of FIG. 2 along line A of FIG. 2.

Referring now to FIG. 2, a second embodiment of a pillow feeding sleeve 20 is shown to include an additional pillow portion 23. The pillow portion 23 is shown to be provided relatively centered within the sleeve 20, and indicates an area of the sleeve that includes extra fill to provide even more cushioning of the infants head. FIG. 3 illustrates a cross-section of the sleeve 20 taken along line A of FIG. 2, illustrating the extra padding 23 within space 26 between linings 22 and 24. The pillow portion 23 has a length $l_1$, which is selected to correspond to the size of an infants head for adding further cradling of the infants head.

Figure 4:
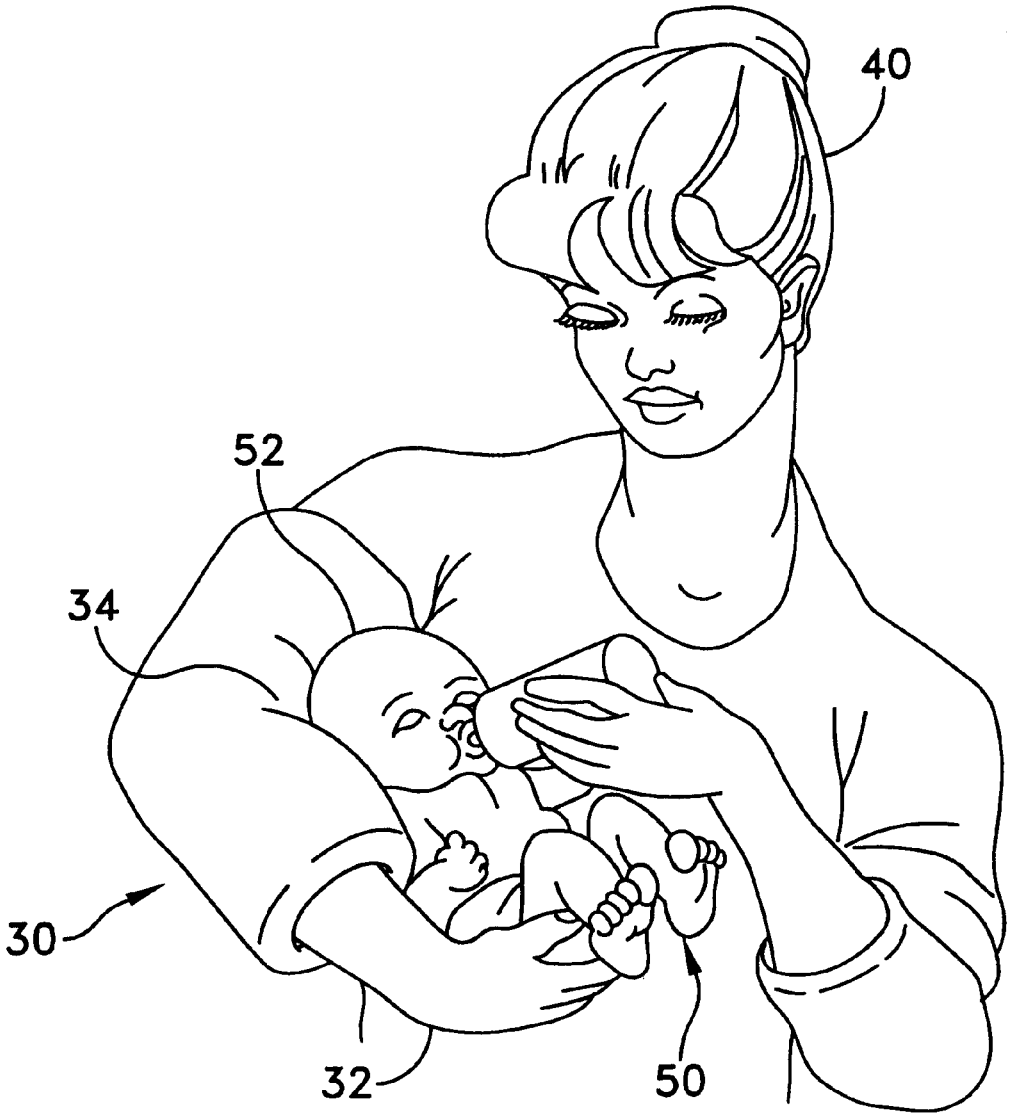
FIG. 4 illustrates the pillow feeding sleeves of either FIG. 1 or FIG. 2 in use.

Referring now to FIG. 4, an illustration of a pillow feeding sleeve 30 in use is shown. The pillow feeding sleeve 30 may be either of the pillow feeding sleeves 10 or 20 illustrated in FIG. 1 or 2, respectively. As shown in FIG. 4, the pillow feeding sleeve 30 is slipped over the arm 32 of the care giver 40. The arm 32 is then bent to cradle the head 52 of infant 50 for feeding. The bending of the arm effectively creates a pillow 34, which raises the infants head to a desired height, thereby reducing the amount of lift or bend required by the care giver. Although FIG. 4 illustrates a care giver bottle feeding the infant, it is readily understood that the invention is equally applicable for use in breast-feeding.

The pillow feeding sleeve described herein has numerous advantages over the prior art. The size of the sleeve makes it easily transportable. The material of which the sleeve is made enables it to be washed regularly to ensure sanitary conditions for feeding. The design enables easy repositioning of the pillow; i.e., the pillow need not even be removed for burping, and switching sides during nursing is enabled merely by switching the sleeve to the other arm. In addition, the design is readily amenable to the addition of accessories. For example, pockets or other attachment means (such as velcro or elastic straps) may be added to either of the linings for holding wipes, pacifiers, bottles and the like.

Having described various embodiments of the invention, it will now become apparent to one of skill in the art that other embodiments incorporating its concepts may be used. It is felt, therefore, that this invention should not be limited to the disclosed embodiment, but rather should be limited only by the spirit and scope of the appended claims.

What we claim is:

1. An infant feeding apparatus comprising:

a tubular sleeve having an interior lining and an exterior lining joined to each other to form a space therebetween, the tubular sleeve having an opening constructed and arranged to receive the arm of a user, and including a first end, a second end, a thickness and a length;

a filler, disposed within the space defined by the interior lining and the exterior lining, the filler extending from the first end to the second end of the sleeve and being distributed throughout the space of the tubular sleeve such that a central portion of the tubular sleeve has a greater thickness than the thickness of the sleeve at either end; and wherein upon inserting the arm of a caregiver within the sleeve, the central portion forms a pillow adapted to rest an infant's head thereon.

2. The infant feeding apparatus of claim 1, wherein each of the interior and exterior linings comprise a different material.

3. The infant feeding apparatus of claim 2, wherein the material of the interior lining has a different texture than the material of the exterior lining.

4. The infant feeding apparatus of claim 1, wherein the filler is selected from a group consisting of down, polyester fiber-fill and air.

5. The infant feeding apparatus of claim 1, wherein each of the interior and exterior linings of the sleeve are comprised of a washable material.

6. The infant feeding apparatus of claim 1, wherein the sleeve is reversible such that either the interior or exterior lining may be utilized in contact with the infant's head.

7. The infant feeding apparatus of claim 1, wherein the sleeve is flexible.

* * * * *